United States Patent [19]

Collingborn

[11] Patent Number: 5,044,893

[45] Date of Patent: Sep. 3, 1991

[54] FUEL INJECTION APPARATUS

[75] Inventor: Peter A. G. Collingborn, Kent, England

[73] Assignee: Lucas Industries Public Limited Company, Birminghan, England

[21] Appl. No.: 561,152

[22] Filed: Aug. 1, 1990

[30] Foreign Application Priority Data

Sep. 8, 1989 [GB] United Kingdom ..... 8920330

[51] Int. Cl.[5] ..... F04B 49/02

[52] U.S. Cl. ..... 417/279; 417/440; 417/462; 123/447; 123/506

[58] Field of Search ..... 123/506, 447, 450; 417/440, 279, 462

[56] References Cited

U.S. PATENT DOCUMENTS 4,474,158 10/1984 Mowbray ..... 123/506

4,691,679 9/1987 Lakin ..... 123/506

4,920,940 5/1990 Harris et al. ..... 417/462

4,922,944 6/1990 Glanvall ..... 417/440

*Primary Examiner*—Richard A. Bertsch

*Assistant Examiner*—Michael I. Kocharov

*Attorney, Agent, or Firm*—Dvorak and Traub

[57] ABSTRACT

A fuel pumping apparatus of the rotary distributor type includes a spill passage 20 connected with the bore 12 which houses the pumping plungers 9. A seating 22 is defined about the spill passage and a valve member 23 is provided for cooperating with the seating. A piston 25 is coupled to the valve member and is slidable in a cylinder. The piston defines a surface against which fuel under pressure from the bore 12 can act to lift the valve member from the seating. The application of fuel under pressure to the surface of the piston is controlled by an electro-magnetically operable control valve 32A.

4 Claims, 1 Drawing Sheet

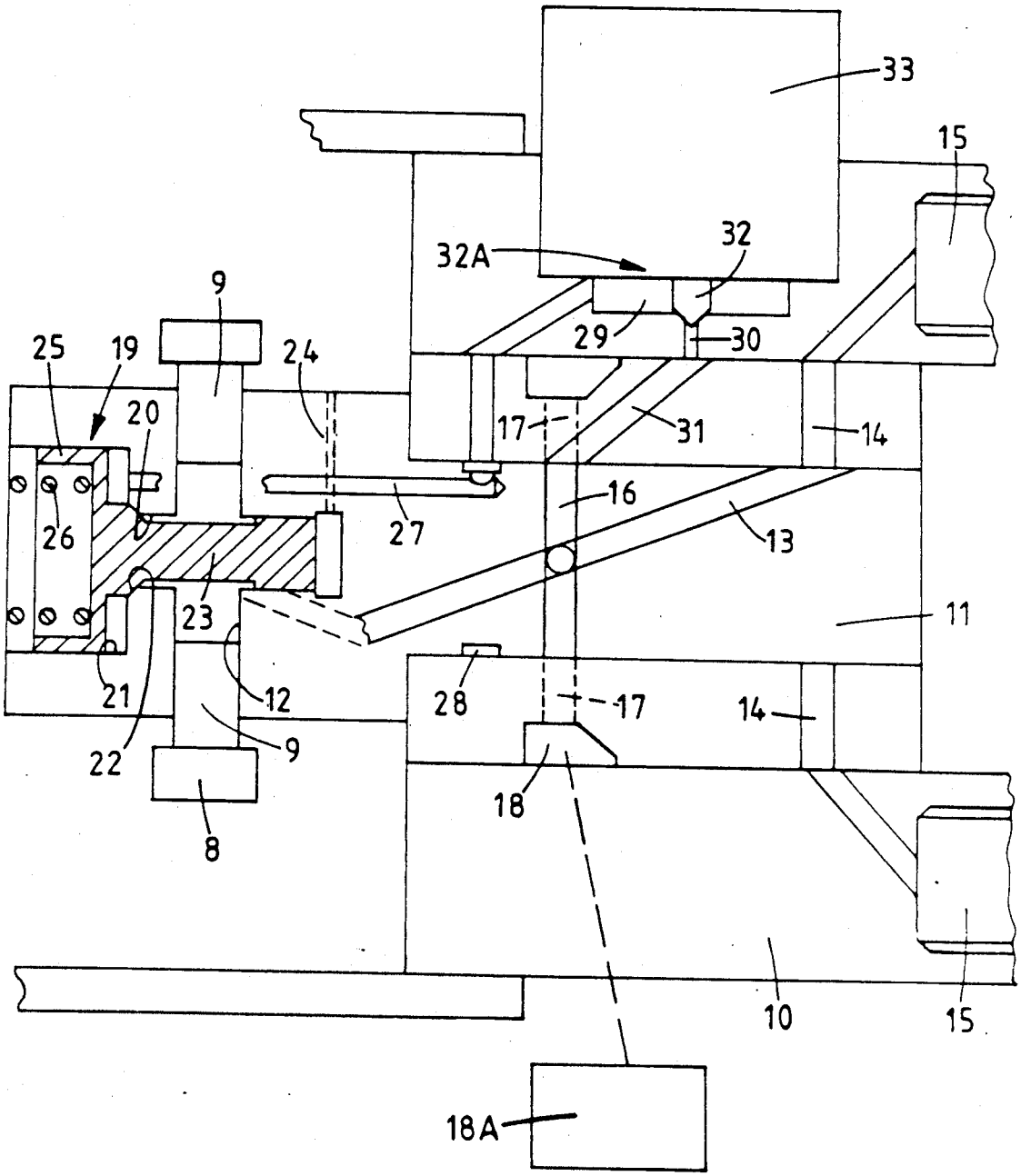
33
15
32A
32
9
29
30
25
19
24
20
17
31
14
16
26
27
13
23
11
21
12
28
17
14
22
9
18
8
10
15
18A

FUEL INJECTION APPARATUS

This invention relates to a fuel injection pumping apparatus for supplying fuel to an internal combustion engine, the apparatus comprising a rotary distributor member housed in a pump body, the distributor member in use being driven in timed relationship with an associated engine, a transverse bore formed in the distributor member and a pair of pumping plungers slidable therein, cam means for imparting inward movement to the pumping plungers as the distributor member rotates, a delivery passage connected to said bore and extending to the periphery of the distributor member for registration in turn with a plurality of outlet ports during successive inward movements of the plungers, means for supplying fuel to the bore to effect maximum outward movement of the plungers during at least part of the time the delivery passage is out of register with an outlet port, and valve means operable to spill fuel from said bore during the inward movement of the plungers thereby to terminate delivery of fuel through an outlet port.

The object of the invention is to provide an apparatus of the kind specified in a simple and convenient form.

According to the invention a fuel injection pumping apparatus of the kind specified comprises a spill passage extending from said bore, a seating formed in said spill passage, a valve member engageable with said seating and a piston member which is connected to the valve member, the piston member being slidable within a cylinder and defining a surface against which fuel under pressure can act to lift the valve member from the seating, passage means through which fuel under pressure from said bore can be applied to said surface of the piston member and an electro-magnetically operable control valve in said passage means, said control valve when opened allowing fuel under pressure to act on said surface of the piston member to lift the valve member from the seating to terminate delivery of fuel through an outlet port.

An example of a fuel injection pumping apparatus in accordance with the invention will now be described with reference to the accompanying diagrammatic drawing.

Referring to the drawing the apparatus comprises a multi-part body 10 in which is rotatably mounted a distributor member 11 which is adapted to be driven in timed relationship with the associated engine.

Formed in the distributor member is a transverse bore 12 in which is mounted a pair of pumping plungers 9, the plungers being arranged to be moved inwardly under the action of cam lobes formed on the internal peripheral surface of an annular cam ring 8 which surrounds the distributor member. During inward movement of the plungers fuel is displaced from the bore 12 and flows to a delivery passage 13 which opens onto the periphery of the distributor member 11 at a position to register in turn with a plurality of equi-angularly spaced outlet ports 14 which are formed in the body and which connect with outlets 15. The outlets 15 communicate with the injection nozzles of the associated engine respectively. Communication of the delivery passage with an outlet port is arranged to occur during inward movement of the pumping plungers and fuel will be displaced to the outlet ports in turn during successive inward movements of the plungers.

The bore 12 also communicates with a plurality of inlet passages 16 formed in the distributor member and which can register in turn with inlet ports 17 formed in the body and which at their outer ends are connected to a circumferential groove 18 which is connected to the outlet of a low pressure pump 18A.

Following delivery of fuel and after continued rotation of the distributor member, the passage 13 moves out of register with an outlet port 14 and the inlet passages 16 are brought into register with the inlet ports 17. Fuel can then flow to the bore 12 to effect maximum outward movement of the plungers as determined by the profile of the internal surface of the cam ring or as determined by stop members.

In order to control the amount of fuel which is supplied to the associated engine valve means 19 is provided to spill fuel from the bore 12 during the latter part of the inward movement of the plungers. For this purpose a spill passage 20 is provided and this traverses the bore 12 at right angles thereto. The passage 20 opens at one end into a cylinder 21 and at its point of entry into the cylinder there is formed a seating 22. Slidable within the passage is a valve member 23 which at one end is shaped to co-operate with the seating and at its other end is guided by the wall of the passage 20. The other end of the passage is vented to the interior of the apparatus by means of a bleed passage 24. The end of the valve member which co-operates with the seating is integral with a piston 25 slidable in the cylinder 21 and a spring 26 is provided to bias the valve member into engagement with the seating.

Opening into the cylinder is a passage 27 which communicates with a groove 28 formed on the periphery of the distributor member and the groove 28 is permanently in communication with a valve chamber 29 formed in the body.

Opening into the valve chamber is a small diameter passage 30 which communicates with a further passage 31 formed in the body part and opening onto the periphery of the distributor member at a position to register with one of the inlet passages 16 during the time when the delivery passage 13 is in register with an outlet port 14. At the point of entry of the passage 30 into the valve chamber there is formed a seating with which can co-operate a valve member 32 of a control valve 32A which can be urged into engagement with the seating by energising an electro-magnetic device housed within a housing 33 which serves to close the valve chamber 29.

In operation, during inward movement of the plungers with the valve member 32 urged into engagement with the seating, delivery of fuel to an outlet port 14 will take place as the plungers are moved inwardly. If however the valve member 32 is withdrawn from the seating, fuel at the high pressure attained during the inward movement of the plungers will be admitted into the valve chamber 29 and a pressure pulse will travel into the cylinder 21 to act upon the surface of the piston 25 exposed thereto, the pressure pulse travelling along the passage 27 and the groove 28. The piston 25 will therefore move against the action of the spring 26 and lift the valve member 23 from the seating 22. When this occurs fuel is spilled directly from the bore 12 into the cylinder 21 by way of the passage 20 and the pressure of fuel supplied to the outlet which is in communication with the bore 12, is rapidly reduced allowing the spring loaded valve member in the associated injection nozzle to close thereby to terminate delivery of fuel to the associated engine.

During the filling stroke of the apparatus the fuel previously displaced into the cylinder 21 will be urged back into the bore 12 by the action of the spring 26. Fuel will be displaced through the passage 24 from the inner end of the passage 20. Valve 32 must be closed before the closure of the valve member 23 onto the seating 22 so as to ensure that the valve chamber 29 and the cylinder 21 together with the passages connecting same are full of fuel. In this manner as soon as valve 32 is opened during delivery of fuel there is no delay in the application of the pressure pulse to the piston. Moreover, there is little flow of fuel through the passage 30 and so the passage is of small diameter. A small leakage of fuel takes place from the cylinder 21 along the working clearance between the piston 25 and the wall of the cylinder to ensure that the valve member does move into engagement with the seating.

As a result of the small diameter of the passage 30 the electro-magnetic device contained within the housing 33 does not have to be particularly powerful to maintain the valve member 32 in engagement with the seating whilst fuel is being supplied to the associated engine. This means that a device having a small moving mass can be employed thereby allowing high speed operation of the apparatus at low fuel levels. As illustrated the valve 23 is a balanced valve so that the force exerted by the spring 26 can be kept to a minimum. It is possible however to use an unbalanced valve in which case the spring must be stronger in order to maintain the valve member in engagement with the seating 22.

I claim:

1. A fuel injection pumping apparatus for supplying fuel to an internal combustion engine, comprising a rotary distributor member housed in a pump body, a transverse bore in the distributor member and a pair of pumping plungers slidable therein, a cam for imparting inward movement of the plungers as the distributor member is driven in timed relationship with the associated engine, a delivery passage communicating with the bore for registration in turn with a plurality of outlet ports during successive inward movement of the plungers, means for supplying fuel to the bore to effect maximum outward movement of the plungers during at least part of the time the delivery passage is out of register with an outlet port, valve means operable to spill fuel from said bore during the inward movement of the plungers thereby to terminate delivery of fuel through an outlet port, characterised by a spill passage extending from the bore, a seating formed in said spill passage, a valve member engageable with said seating and a piston member connected to the valve member, the piston member being slidable within a cylinder and defining a surface against which fuel under pressure can act to lift the valve member from the seating, passage means through which fuel under pressure from said bore can be applied to said surface of the piston member and an electro-magnetically operable control valve in said passage means, said control valve when opened allowing fuel under pressure to act on said surface of the piston member to lift the valve member from the seating to terminate delivery of fuel through an outlet port.

2. An apparatus according to claim 1, characterised in that the fuel which is spilled from said bore flows into said cylinder to effect further displacement of the piston member and the valve member away from the seating.

3. An apparatus according to claim 1, characterized in that said passage means includes a passage of small diameter, a seating formed about the passage and the valve member of said control valve cooperating with said seating.

4. An apparatus according to claim 2, characterized in that said passage means includes a passage of small diameter, a seating formed about the passage and the valve member of said control valve cooperating with said seating.

* * * * *